US012509842B1

(12) United States Patent
Wu

(10) Patent No.: US 12,509,842 B1
(45) Date of Patent: Dec. 30, 2025

(54) WATERPROOF STRUCTURE FOR A PANEL JOINT OF AN UNDERGROUND DIAPHRAGM WALL

(71) Applicant: Zhaosheng Wu, Shenzhen (CN)

(72) Inventor: Zhaosheng Wu, Shenzhen (CN)

( * ) Notice: Subject to any disclaimer, the term of this patent is extended or adjusted under 35 U.S.C. 154(b) by 0 days.

(21) Appl. No.: 19/069,232

(22) Filed: Mar. 4, 2025

(30) Foreign Application Priority Data

Jan. 3, 2025 (CN) ..... 202520028434.6

(51) Int. Cl.
*E02D 27/00* (2006.01)
*E02D 29/16* (2006.01)

(52) U.S. Cl.
CPC ..... *E02D 29/16* (2013.01)

(58) Field of Classification Search
CPC ..... E02D 29/16
See application file for complete search history.

(56) References Cited

U.S. PATENT DOCUMENTS 2,400,493 A * 5/1946 Fischer ..... E04B 1/6812 404/49
3,172,237 A * 3/1965 Bradley ..... E01C 11/106 52/99
3,417,528 A * 12/1968 Hallock ..... E04B 1/6804 52/367
3,434,401 A * 3/1969 Kiewit ..... E02B 3/16 404/65
3,659,390 A * 5/1972 Balzer ..... E04B 1/6804 404/69
3,880,539 A * 4/1975 Brown ..... E01D 19/06 14/73.1
4,127,350 A * 11/1978 Weber ..... E01C 11/106 52/396.06
4,295,315 A * 10/1981 Lynn-Jones ..... E04B 1/6804 404/69
4,533,278 A * 8/1985 Corsover ..... E01C 11/10 404/69
4,555,885 A * 12/1985 Raymond ..... E04F 19/062 52/287.1
4,566,242 A * 1/1986 Dunsworth ..... E04B 1/946 52/396.01
4,793,162 A * 12/1988 Emmons ..... E02B 3/16 404/69

(Continued)

*Primary Examiner* — Basil S Katcheves
(74) *Attorney, Agent, or Firm* — Li & Cai Intellectual Property Office

(57) ABSTRACT

A waterproof structure for a panel joint of an underground diaphragm wall includes a first waterstop and a first cover plate. The panel joint is provided with a wall connection plate. The underground diaphragm wall has an excavation surface. In a direction perpendicular to the excavation surface, the wall connection plate is arranged below the excavation surface of the underground diaphragm wall. A first accommodating groove is defined between the wall connection plate and the panel joint and adjacent to the excavation surface. The first waterstop is arranged in the first accommodating groove, and both wings of the first waterstop are respectively and adhesively bonded to the two sides of the panel joint. The first cover plate corresponds to the first accommodating groove and is arranged at the excavation surface. The first cover plate is detachably connected to the underground diaphragm wall.

8 Claims, 8 Drawing Sheets

(56) References Cited

U.S. PATENT DOCUMENTS 4,882,890 A * 11/1989 Rizza ..... E04D 13/151 52/464
4,884,381 A * 12/1989 Betti ..... E04B 1/6801 52/396.06
4,914,884 A * 4/1990 Ohmatsu ..... E04B 1/6815 404/47
5,060,439 A * 10/1991 Clements ..... E04B 1/6815 404/54
5,082,394 A * 1/1992 George ..... E01D 19/06 404/67
5,171,100 A * 12/1992 Bergstedt ..... E01C 11/106 52/396.04
5,197,250 A * 3/1993 Kramer ..... E01C 11/10 404/69
5,249,401 A * 10/1993 Schmid ..... E02D 29/16 52/576
5,259,162 A * 11/1993 Nicholas ..... E04B 1/681 52/468
5,461,838 A * 10/1995 Heller ..... E04B 1/948 52/573.1
5,531,455 A * 7/1996 Calixto ..... E02D 29/16 277/637
5,584,152 A * 12/1996 Baerveldt ..... B29C 48/11 404/69
6,619,879 B1 * 9/2003 Scuero ..... E04B 1/6809 404/74
6,751,919 B2 * 6/2004 Calixto ..... E04B 1/6816 52/471
6,854,737 B2 * 2/2005 Fieger ..... E01D 19/06 277/630
7,744,307 B2 * 6/2010 Moor ..... E01D 22/00 404/75
8,499,394 B1 * 8/2013 Haydu ..... E01D 19/06 404/69
8,602,678 B2 * 12/2013 Kawamoto ..... E01D 19/06 404/49
8,683,773 B2 * 4/2014 Emmons ..... E04B 1/6812 52/742.16
11,414,856 B2 * 8/2022 Wu ..... E04B 1/6812
2016/0319536 A1 * 11/2016 Wilkes, Jr. ..... E02D 29/16

* cited by examiner

WATERPROOF STRUCTURE FOR A PANEL JOINT OF AN UNDERGROUND DIAPHRAGM WALL

CROSS-REFERENCE TO RELATED PATENT APPLICATION

This application claims the benefit of priority to China Patent Application No. 202520028434.6, filed on Jan. 3, 2025, in the People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to the technical field of waterproofing for underground diaphragm walls, specifically to a waterproof structure for a panel joint of an underground diaphragm wall.

BACKGROUND OF THE DISCLOSURE

Underground diaphragm walls have been increasingly applied in construction engineering, with panel joint waterproofing between panels being a critical aspect of the technology. Traditional waterproofing structures for panel joints in underground diaphragm walls typically use embedded rubber waterstops, while the wall is made of reinforced concrete. Due to the lack of adhesion between concrete and rubber, combined with factors such as concrete shrinkage, creep, aging, and hardening of rubber waterstops, gaps often form between the wall and the embedded rubber waterstops. Additionally, since embedded rubber waterstops are located within the middle of the wall, effective maintenance is not feasible. Consequently, leakage frequently occurs at the panel joints of underground diaphragm walls.

SUMMARY OF THE DISCLOSURE

The objective of the present disclosure is to provide a waterproof structure for a panel joint of an underground diaphragm wall. This structure enhances the reliability of waterproofing at the panel joints of underground diaphragm walls and facilitates convenient maintenance.

In order to achieve the aforementioned objective, the present disclosure provides a waterproof structure for a panel joint of an underground diaphragm wall, including: a first waterstop and a first cover plate; wherein the panel joint is provided with a wall connection plate, and the underground diaphragm wall has an excavation surface; in a direction perpendicular to the excavation surface, the wall connection plate is arranged below the excavation surface of the underground diaphragm wall, and form a first accommodating groove is defined between the wall connection plate and the panel joint and adjacent to the excavation surface; the first waterstop is arranged in the first accommodating groove, and both wings of the first waterstop are respectively and adhesively bonded to two sides of the panel joint; and the first cover plate corresponds to the first accommodating groove and is arranged at the excavation surface, and the first cover plate is detachably connected to the underground diaphragm wall.

In some embodiments, the first waterstop includes a U-shaped shell and a polyurethane foam disposed within the U-shaped shell.

In some embodiments, the U-shaped shell is elastic.

In some embodiments, the U-shaped shell has an open end and a closed end opposite the open end, the open end faces the wall connection plate, and the closed end faces the first cover plate.

In some embodiments, the wall connection plate has a first end adjacent to the excavation surface, the first end is provided with a plurality of connection holes, centerlines of the plurality of connection holes are perpendicular to the excavation surface, the plurality of connection holes are configured to detachably connect forming template of the first accommodating groove with the wall connection plate.

In some embodiments, the wall connection plate includes a first plate perpendicular to the excavation surface and a second plate parallel to the excavation surface, the first plate is arranged at the panel joint, the second plate extends into walls on the two sides of the panel joint, the wall includes a reinforcement cage, and the second plate is connected to the reinforcement cage.

In some embodiments, the waterproof structure further includes a second waterstop, a waterstop elbow, and a second cover plate; a second accommodating groove is provided in a basement floor corresponding to the panel joint; the second waterstop is arranged in the second accommodating groove, and the waterstop elbow is correspondingly connected to the first waterstop and the second waterstop; and the second cover plate corresponds to the second accommodating groove and is arranged on the basement floor, and the second cover plate is detachably connected to the basement floor.

In some embodiments, each of a cross-section of the waterstop elbow, a cross-section of the first waterstop, and a cross-section of the second waterstop is an U-shaped structure; and each end of the waterstop elbow is provided with a lip, the first waterstop and the second waterstop respectively overlap on the lips of the waterstop elbow and are adhesively bonded to the lip.

Compared to the prior art, the present disclosure offers at least the following advantageous effects.

Since the first waterstop is arranged in the first accommodating groove of the panel joint, and both wings of the first waterstop are respectively and adhesively bonded to the two sides of the panel joint, there are no leakage gaps at the panel joint of the wall. Therefore, compared to embedded rubber waterstops, the waterproof structure of the present disclosure offers higher waterproofing reliability.

The first waterstop is arranged adjacent to the excavation surface of the underground diaphragm wall and adopts an adhesive bonding method, thus making maintenance of the waterproof structure in the present disclosure more convenient than that of embedded rubber waterstops.

The first waterstop uses an internal adhesive bonding method, which protects the waterstop from damage during construction at sites with overlapping tasks.

REFERENCE NUMERALS

100, Underground diaphragm wall; 101, First panel of the wall; 102, Panel joint; 103, Second panel of the wall; 104, First accommodating groove; 105, Third panel of the wall; 200, Wall connection plate; 201, Connection hole; 202, Second plate; 203, First plate; 300, First waterstop; 301, Shell; 302, Polyurethane foam; 400, First cover plate; 401, Top explosion bolt; 500, Forming template; 501, Countersunk hole; 502, Countersunk bolt; 600, Panel joint box; 700, Reinforcement cage; 800, Waterstop elbow; 801, Lip; 900, Second waterstop; 1000, Second cover plate; 1100, Basement floor; 1101, Second accommodating groove.

DETAILED DESCRIPTION OF THE EXEMPLARY EMBODIMENTS

The present disclosure adopts an adhesive-type waterstop, with both wings of the waterstop respectively and adhesively bonded to the concrete walls on both sides of the panel joint, which eliminates the gaps between the waterstop and the panel joint and significantly enhances the waterproofing reliability of the panel joint. Since the waterstop is arranged on the excavation side of the underground diaphragm wall, adjacent to the excavation surface, it facilitates maintenance, and the alignment allows the waterproofing system's service life to match that of the building.

Below, the technical solutions of the embodiments of the present disclosure will be described clearly and comprehensively with reference to the accompanying drawings. It is evident that the described embodiments represent only a portion of the present disclosure and not all possible embodiments. Based on the embodiments of the present disclosure, all other embodiments that can be obtained by those skilled in the art without requiring inventive effort fall within the scope of the present disclosure.

Furthermore, if terms such as "first" or "second" are mentioned in the embodiments, they are only for descriptive purposes and should not be understood as indicating relative importance or the quantity of the technical features implied. Features labeled as "first" or "second" may explicitly or implicitly include at least one of the features. Additionally, the technical solutions described in different embodiments may be combined, provided that such combinations are feasible for those skilled in the art. If contradictions or infeasibility arise from combining technical solutions, such combinations should be considered non-existent and outside the scope of protection of the present disclosure.

Figure 1:
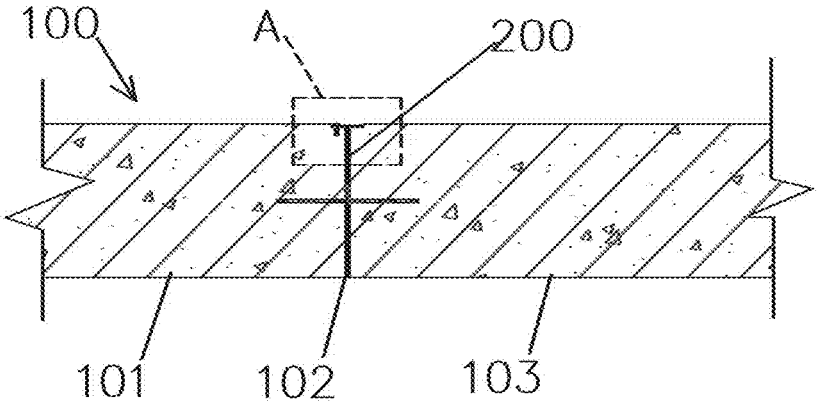
FIG. 1 is a schematic diagram of some embodiments of a waterproof structure for a panel joint of an underground diaphragm wall.
Figure 2:
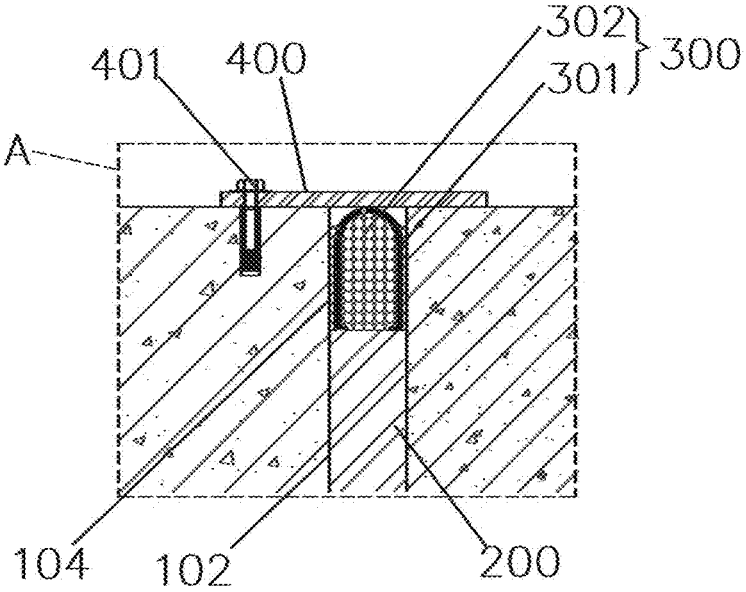
FIG. 2 is an enlarged view of part A in FIG. 1.

Referring to FIGS. 1 and 2, in some embodiments, a waterproof structure for a panel joint of an underground diaphragm wall 100 includes a first waterstop 300 and a first cover plate 400.

The underground diaphragm wall 100 is a concrete wall, which has an excavation surface and a soil-facing side. The soil-facing side and the excavation surface are spatially opposite to each other, as in FIG. 1 where the upper side is the excavation surface and the lower side is the soil-facing side.

A panel joint 102 is equipped with a wall connection plate 200. In a direction perpendicular to the excavation surface, that is a vertical direction in FIG. 2, the wall connection plate 200 is arranged below the excavation surface of the underground diaphragm wall 100. This configuration allows a first accommodating groove 104 to be defined between the wall connection plate 200 and the panel joint 102 and adjacent to the excavation surface.

The first waterstop 300 is arranged in the first accommodating groove 104, and both wings of the first waterstop 300 are respectively and adhesively bonded to two sides of the panel joint 102.

The first cover plate 400 is arranged at the excavation surface corresponding to the first accommodating groove 104, and is detachably connected to the underground diaphragm wall 100. Specifically, the first cover plate 400 is detachably connected to the wall using top explosion bolts 401, and the first cover plate 400 is preferably made of steel.

Since the first waterstop 300 is arranged in the first accommodating groove 104 within the panel joint 102, and two wings of the first waterstop 300 are respectively bonded to the two sides of the panel joint 102, there are no leakage gaps at the wall panel joint. Therefore, compared to the embedded rubber waterstops, the waterproof structure offers higher reliability.

Because the first waterstop 300 is arranged adjacent to the excavation surface of the underground diaphragm wall 100 and is adhesively bonded to the wall, the first waterstop 300 can be removed and replaced after the first cover plate 400 is detached, so as to make maintenance of this waterproof structure more convenient than the embedded rubber waterstops and allow service life of the waterproofing system to match service life of the building.

Since the adhesive bonding method is used for the first waterstop 300, it can protect the waterstop from damage in construction sites with overlapping operations.

Figure 3:
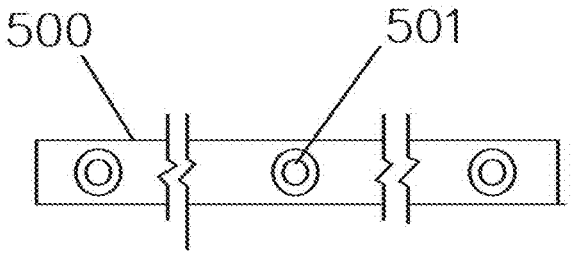
FIG. 3 is a schematic diagram of a forming template.
Figure 4:
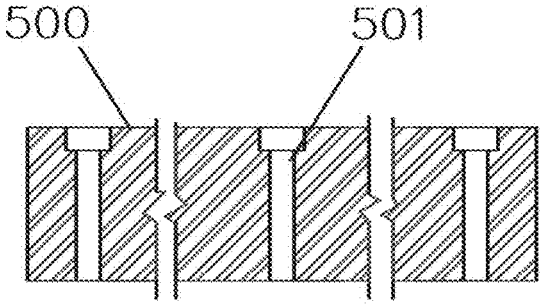
FIG. 4 is a cross-sectional view of FIG. 3.

The first accommodating groove 104 can be directly formed during wall casting, specifically using a forming template 500. FIGS. 3 and 4 illustrate the structure of the forming template 500, while FIG. 5 shows the structure after combining the forming template 500 with the wall connection plate 200.

Figure 5:
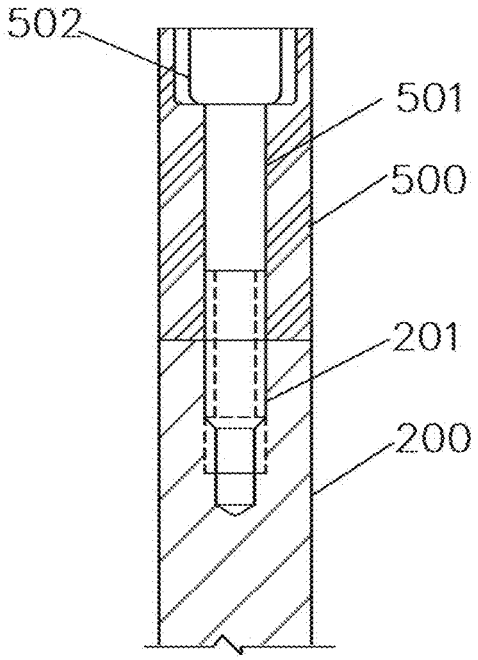
FIG. 5 is a schematic diagram illustrating a combination of the forming template and a wall connection plate.

Referring to FIGS. 1 to 5, the wall connection plate 200 has a first end adjacent to the excavation surface, and the first end corresponds to the upper end as shown in FIG. 5. The first end of the wall connection plate 200 is equipped with a plurality of connection holes 201. Centerlines of the plurality of connection holes 201 are perpendicular to the excavation surface. The plurality of connection holes 201 are configured to detachably connect the forming template 500 to the wall connection plate 200. The forming template 500 is provided with countersunk holes 501, and the countersunk holes 501 correspond to the plurality of connection holes 201 on the wall connection plate 200. A countersunk bolt 502 is installed in the countersunk hole 501 and connected to the connection hole 201 on the wall connection plate 200, thereby securing the forming template 500 to the first end of the wall connection plate 200.

Before casting the wall, the forming template 500 is connected to the first end of the wall connection plate 200. After wall casting is completed, the forming template 500 is removed, and a groove formed by the forming template 500 in the wall is the first accommodating groove 104, and the first accommodating groove 104 is configured to install the first waterstop 300.

By detachably connecting the forming template 500 to the first end of the wall connection plate 200, the first accommodating groove 104 can be reserved during wall casting.

Figure 6:
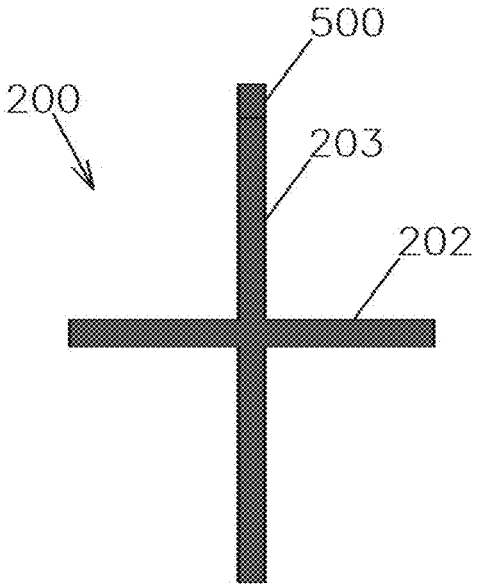
FIG. 6 is a schematic diagram of the wall connection plate.
Figure 8:
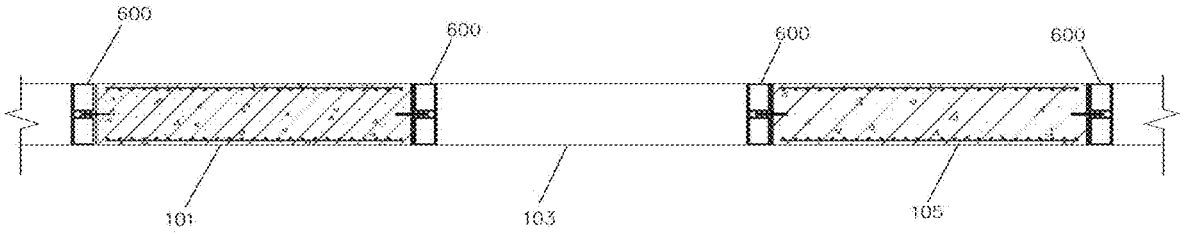
FIG. 8 is a schematic diagram of the complete wall construction.

Referring to FIGS. 1, 6, and 8, the wall connection plate 200 includes a first plate 203 perpendicular to the excavation surface and a second plate 202 parallel to the excavation surface. The first plate 203 is arranged at the panel joint 102, and the second plate 202 extends into walls on the two sides of the panel joint 102. The wall includes a reinforcement cage 700, and the second plate 202 is connected to the reinforcement cage 700. The forming template 500 is connected to the first plate 203.

In the present embodiment, the wall connection plate 200 includes one second plate 202, and the wall connection plate 200 is cross-shaped. Alternatively, the number of second plates 202 on the wall connection plate 200 can be two or more, with all second plates 202 arranged in parallel.

By welding the second plate 202 of the wall connection plate 200 to the reinforcement cage 700, the forming template 500, the wall connection plate 200, and the reinforcement cage 700 are integrated, such that displacement of the wall connection plate 200 during wall casting can be reduced to ensure that the first accommodating groove 104 remains perpendicular to the excavation surface, thereby facilitating the installation of the first waterstop 300.

The first waterstop 300 is strip-shaped, with a width matching a width of the first accommodating groove 104.

The first waterstop 300 can be made of a single material or a composite material.

Single-material waterstops may include polyvinyl chloride (PVC) waterstops, rubber waterstops, or other polymer waterstops.

Referring to FIG. 2, in one embodiment, the first waterstop 300 that is made of the composite material includes a U-shaped shell 301 and a polyurethane foam 302 arranged inside the U-shaped shell 301. The U-shaped shell 301 has an open end and a closed end opposite to the open end. The open end faces the wall connection plate 200 and the closed end faces the first cover plate 400. The closed end of the U-shaped shell 301 can contact the first cover plate 400, or the closed end of the U-shaped shell 301 can not contact the first cover plate 400. The U-shaped shell 301 is elastic and can be made of materials such as PVC, rubber, or other polymers. The polyurethane foam 302 helps the shell 301 maintains its shape, while the shell 301 provides good strength, facilitating adhesion and ensuring reliable sealing. The use of the elastic shell 301 compensates for width variations in the first accommodating groove 104 caused by deformation.

The construction method for the above waterproof structure is as follows.

Figure 7:
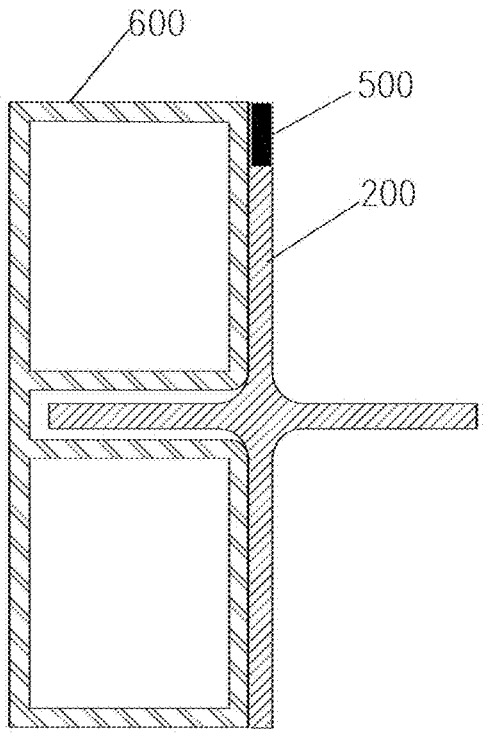
FIG. 7 is a schematic diagram illustrating a combination of a panel joint box, the wall connection plate, and the forming template.

Step 1: the panel joint box 600, the wall connection plate 200, the forming template 500, and the reinforcement cage 700 are provided. FIG. 7 illustrates a combined state of the panel joint box 600, the wall connection plate 200, and the forming template 500.

Figure 9:
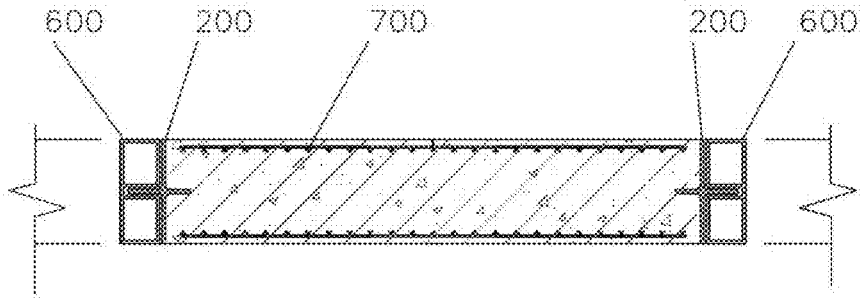
FIG. 9 is a schematic diagram of single-panel wall construction.

Step 2: the construction of all wall panels is completed. As shown in FIG. 8, first pouring the concrete for the first wall panel 101 and the third wall panel 105, followed by the second wall panel 103. In FIG. 8, the left side represents the first wall panel 101, the right side represents the third wall panel 105, and the middle represents the second wall panel 103. Before pouring the third wall panel 105, the panel joint box 600 on the right side of the first wall panel 101 and the panel joint box 600 on the left side of the third wall panel 105 are removed. This process is repeated to complete all wall panels. Refer to FIG. 9, a single wall panel is constructed as follows: excavating the groove by using a grab bucket, installing the panel joint box 600, placing the reinforcement cage 700, the wall connection plate 200, and the forming template 500 into the groove, pouring the concrete, and then completing the construction of the single wall panel. After construction, the wall connection plate 200 remains inside the underground diaphragm wall 100, while the panel joint box 600 does not remain inside the underground diaphragm wall 100.

Figure 10:
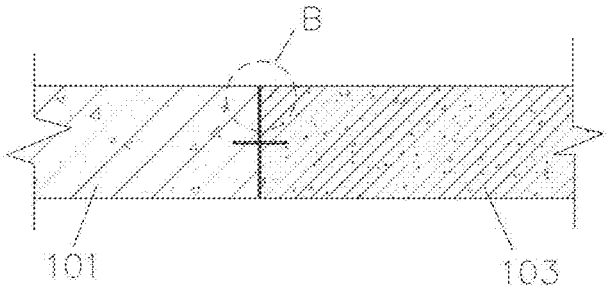
FIG. 10 is a schematic diagram of a wall after concrete pouring is completed.
Figure 11:
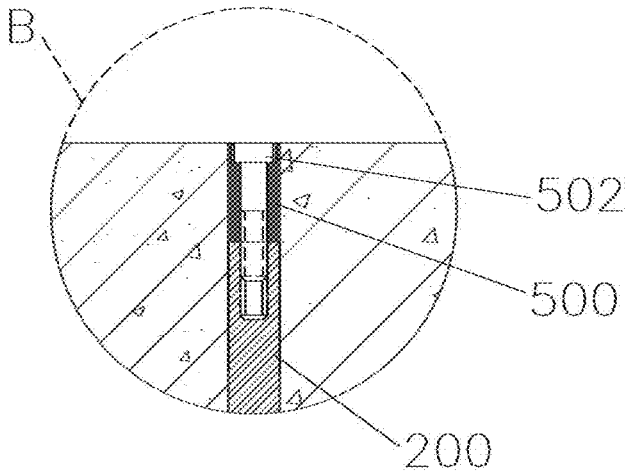
FIG. 11 is an enlarged view of part B in FIG. 10.

Step 3: after excavating the interior of the underground diaphragm wall 100, the panel joint 102 is exposed. Refer to FIGS. 10 and 11, the countersunk bolt 502 is removed, the forming template 500 is detached, and the concrete surface within the panel joint is cleaned and repaired.

Step 4: epoxy resin adhesive is used to bond the first waterstop 300.

Step 5: the first cover plate 400 is installed on an outer face of the first waterstop 300 and the top explosion bolt 401 on one side of the first cover plate 400 is used for fixing.

The construction is completed after the above steps are finished, and the final state is shown in FIGS. 1 and 2.

To ensure waterproofing at the panel joint between the underground diaphragm wall and the basement floor, the following treatment is applied at the end of the first waterstop 300.

Figure 12:
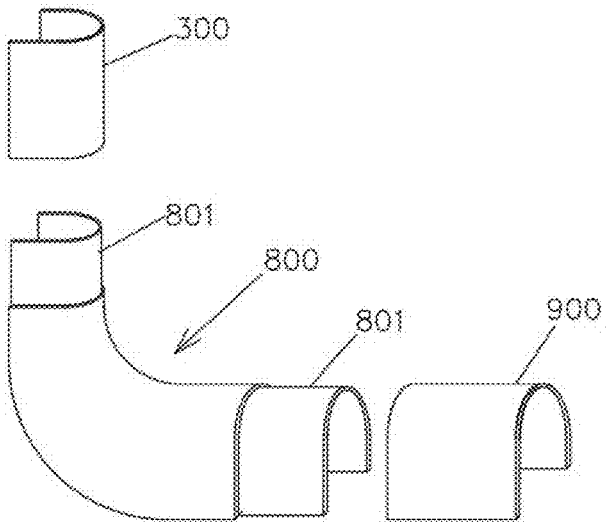
FIG. 12 is a schematic diagram illustrating a first waterstop, a waterstop elbow, and a second waterstop before being combined.
Figure 13:
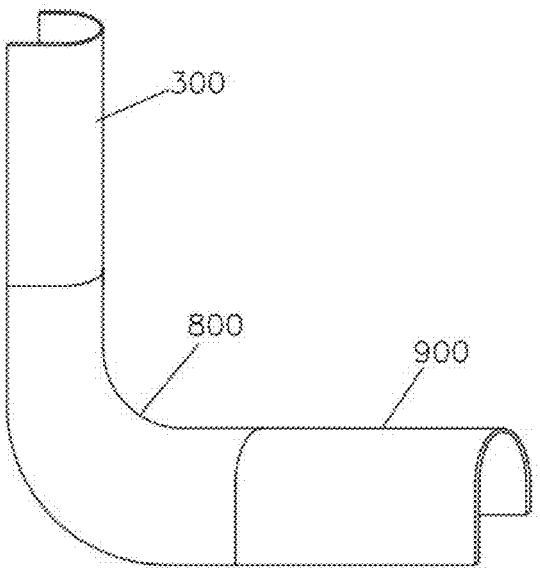
FIG. 13 is a schematic diagram illustrating the first waterstop, the waterstop elbow, and the second waterstop after being combined.
Figure 14:
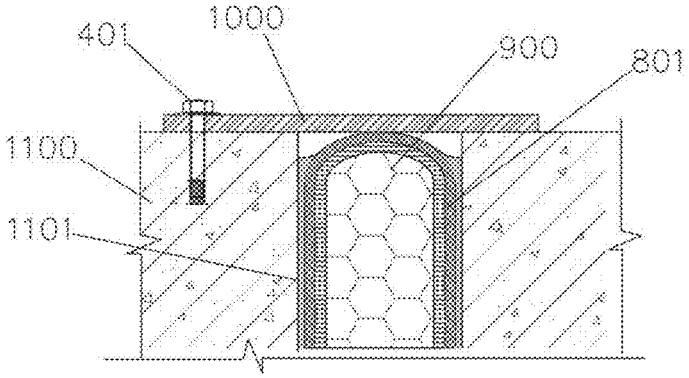
FIG. 14 is a schematic diagram illustrating a state of the second waterstop, the waterstop elbow, and a second cover plate after being installed on a basement floor.

As shown in FIGS. 12 and 14, the waterproof structure further includes a second waterstop 900, a waterstop elbow 800, and a second cover plate 1000.

On a basement floor 1100, at the position corresponding to the panel joint 102, a groove is cut to a depth of 60 mm, a width of 20 mm, and a length of 100 mm to form a second accommodating groove 1101. An epoxy resin adhesive is then used to bond the second waterstop 900 into the second accommodating groove 1101. The waterstop elbow 800 is correspondingly bonded to the first waterstop 300 and the second waterstop 900. A second cover plate 1000 is provided on the basement floor 1100 corresponding to the second accommodating groove 1101. One side of the second cover plate 1000 is secured with the top-expansion bolt 401 and is detachably connected to the basement floor 1100.

By extending the waterproof structure of the panel joint 102 to the basement floor 1100 through the waterstop elbow 800 and the second waterstop 900, water infiltration from a bottom of the panel joint 102 is prevented, thereby achieving superior waterproofing performance.

Each of a cross-section of the waterstop elbow 800, a cross-section of the first waterstop 300, and a cross-section of the second waterstop 900 is a U-shaped structure.

Each end of the waterstop elbow 800 is equipped with a lip 801. The first waterstop 300 overlaps on the lip 801 at one end, while the second waterstop 900 overlaps on the lip 801 at the other end. The overlapping parts are adhesively bonded. Compared to butt-panel joint connections, the lap panel joint provides a larger bonding surface. Combined with adhesive bonding at the overlapping parts, the connection strength of the waterstop at the panel joint is ensured to be no less than that of the waterstop body.

Specifically, after applying adhesive to the first waterstop 300, the second waterstop 900, and the waterstop elbow 800, they are clamped with a mold to ensure reliable bonding at their overlapping sections. The three parts are then combined into a single assembly, which is subsequently installed as a whole into the accommodating grooves in the wall and floor. This method makes the installation more convenient and reliable.

The above detailed description of the specific embodiments is intended solely to assist those skilled in the art in understanding the content of the present disclosure. It should not be construed as limiting the scope of protection of the present disclosure. Any modifications, equivalent transformations, or refinements made by those skilled in the art based on the concept of the present disclosure should fall within the scope of protection of the present disclosure.

What is claimed is:

1. A waterproof structure for a panel joint (102) of an underground diaphragm wall (100), comprising:

a first waterstop (300) and a first cover plate (400);

wherein the panel joint (102) is provided with a wall connection plate (200), and the underground diaphragm wall (100) has an excavation surface; in a direction perpendicular to the excavation surface, the wall connection plate (200) is arranged below the excavation surface of the underground diaphragm wall (100), and a first accommodating groove (104) is defined between the wall connection plate (200) and the panel joint (102) and adjacent to the excavation surface;

wherein the first waterstop (300) is arranged in the first accommodating groove (104), and two wings of the first waterstop (300) are respectively and adhesively bonded to two sides of the panel joint (102); and wherein the first cover plate (400) corresponds to the first accommodating groove (104) and is arranged at the excavation surface, and the first cover plate (400) is detachably connected to the underground diaphragm wall (100).

2. The waterproof structure for the panel joint (102) of the underground diaphragm wall (100) according to claim 1, wherein the first waterstop (300) includes a U-shaped shell (301) and a polyurethane foam (302) disposed within the U-shaped shell (301).

3. The waterproof structure for the panel joint (102) of the underground diaphragm wall (100) according to claim 2, wherein the U-shaped shell (301) is elastic.

4. The waterproof structure for the panel joint (102) of the underground diaphragm wall (100) according to claim 2, wherein the U-shaped shell (301) has an open end and a closed end opposite the open end, the open end faces the wall connection plate (200), and the closed end faces the first cover plate (400).

5. The waterproof structure for the panel joint (102) of the underground diaphragm wall (100) according to claim 1, wherein the wall connection plate (200) has a first end adjacent to the excavation surface, the first end is provided with a plurality of connection holes (201), centerlines of the plurality of connection holes (201) are perpendicular to the excavation surface, the plurality of connection holes (201) are configured to detachably connect a forming template (500) of the first accommodating groove (104) with the wall connection plate (200).

6. The waterproof structure for the panel joint (102) of the underground diaphragm wall (100) according to claim 5, wherein the wall connection plate (200) includes a first plate (203) perpendicular to the excavation surface and a second plate (202) parallel to the excavation surface, the first plate (203) is arranged at the panel joint (102), the second plate (202) extends into walls on the two sides of the panel joint (102), the wall includes a reinforcement cage (700), and the second plate (202) is connected to the reinforcement cage (700).

7. The waterproof structure for the panel joint (102) of the underground diaphragm wall (100) according to claim 1, wherein the waterproof structure further comprises a second waterstop (900), a waterstop elbow (800), and a second cover plate (1000);

a second accommodating groove (1101) is provided in a basement floor corresponding to the panel joint (102);

the second waterstop (900) is arranged in the second accommodating groove (1101), and the waterstop elbow (800) is correspondingly connected to the first waterstop (300) and the second waterstop (900); and the second cover plate (1000) corresponds to the second accommodating groove (1101) and is arranged on the basement floor, and the second cover plate (1000) is detachably connected to the basement floor.

8. The waterproof structure for the panel joint (102) of the underground diaphragm wall (100) according to claim 7, wherein each of a cross-section of the waterstop elbow (800), a cross-section of the first waterstop (300), and a cross-section of the second waterstop (900) is an U-shaped structure; and each end of the waterstop elbow (800) is provided with a lip (801), the first waterstop (300) and the second waterstop (900) respectively overlap on the lips (801) of the waterstop elbow (800) and are adhesively bonded to the lip (801).

* * * * *